United States Patent [19]

Klein

[11] 4,307,539

[45] Dec. 29, 1981

[54] TOY SIMULATING A PHYSICIAN'S INSTRUMENT

[76] Inventor: Claus-Dieter Klein, Burgstr. 16, 6741 Ramberg, Pfalz, Fed. Rep. of Germany

[21] Appl. No.: 116,976

[22] Filed: Jan. 30, 1980

[30] Foreign Application Priority Data

| | | | |
|---|---|---|---|
| Mar. 10, 1979 | [DE] | Fed. Rep. of Germany | 7906678[U] |
| Apr. 2, 1979 | [DE] | Fed. Rep. of Germany | 7909495[U] |
| May 25, 1979 | [DE] | Fed. Rep. of Germany | 7915092[U] |
| May 25, 1979 | [DE] | Fed. Rep. of Germany | 7915094[U] |
| May 25, 1979 | [DE] | Fed. Rep. of Germany | 7915095[U] |

[51] Int. Cl.[3] ..... A63H 33/26; A63H 33/30

[52] U.S. Cl. ..... 46/228; 46/226; 46/39; 46/1 R

[58] Field of Search ..... 46/44, 88, 1 R, 175 R, 46/226, 227, 228, 229, 39

[56] References Cited

U.S. PATENT DOCUMENTS

| | | | |
|---|---|---|---|
| 2,749,663 | 6/1956 | Lemelson | 46/228 |
| 3,024,568 | 3/1962 | Barnett | 46/39 |
| 3,232,004 | 2/1966 | Felsher | 46/236 |
| 3,374,572 | 3/1968 | Course | 46/1 R |
| 4,174,588 | 11/1979 | Clanton | 46/44 |

*Primary Examiner*—Gene Mancene
*Assistant Examiner*—Michael J. Foycik
*Attorney, Agent, or Firm*—Karl F. Ross

[57] ABSTRACT

A toy for a pseudo-medical kit, such as a make-believe reflex hammer, stethoscope, thermometer, sphygmomanometer or syringe, has a nonfunctional mobile part which resembles a functional element of the instrument simulated thereby and whose displacement or deformation produces a perceptible indication, such as the lighting of a lamp, a whistling sound, or the display of a numerical or pictorial reading.

4 Claims, 19 Drawing Figures

TOY SIMULATING A PHYSICIAN'S INSTRUMENT

FIELD OF THE INVENTION

My present invention relates to a toy, designed to simulate a physician's instrument, which can form part of a pseudo-medical kit to be used by children playing doctors or nurses.

BACKGROUND OF THE INVENTION

There are a number of toys on the market which are designed as make-believe medical instruments but, lacking movable parts, do not produce any effect that would stimulate the child's mind into learning about the mode of operation of the instruments they resemble. In a few instances, devices of this nature may have a dial coacting with a manually rotatable pointer in a manner similar to that of the hands of a toy clock. For the most part, however, they are only dummy replicas of the original.

OBJECT OF THE INVENTION

The object of my present invention, therefore, is to provide a toy of the type referred to which, while obviously without diagnostic or therepeutic utility, still satisfies a child's natural urge for action and also tends to familiarize the young user with the operation of certain clinical implements which such child at one time or another may have to confront in the hands of a medical doctor.

SUMMARY OF THE INVENTION

I realize this object, in accordance with my present invention, by the provision of a toy having a body which generally conforms to the shape of the instrument simulated thereby and which is connected with a displaceable member resembling a functional element of the simulated instrument, in combination with signaling means operatively coupled with that member for giving a perceptible (visual or audible) indication upon a displacement thereof unrelated to the function of the actual element which it resembles.

In a preferred embodiment, and as particularly claimed herein, the displaceable member is shaped to resemble a chest piece of a stethoscope.

BRIEF DESCRIPTION OF THE DRAWING

The above and other features of my present invention will now be described in detail with reference to the accompanying drawing in which.

SPECIFIC DESCRIPTION

Figure 1:
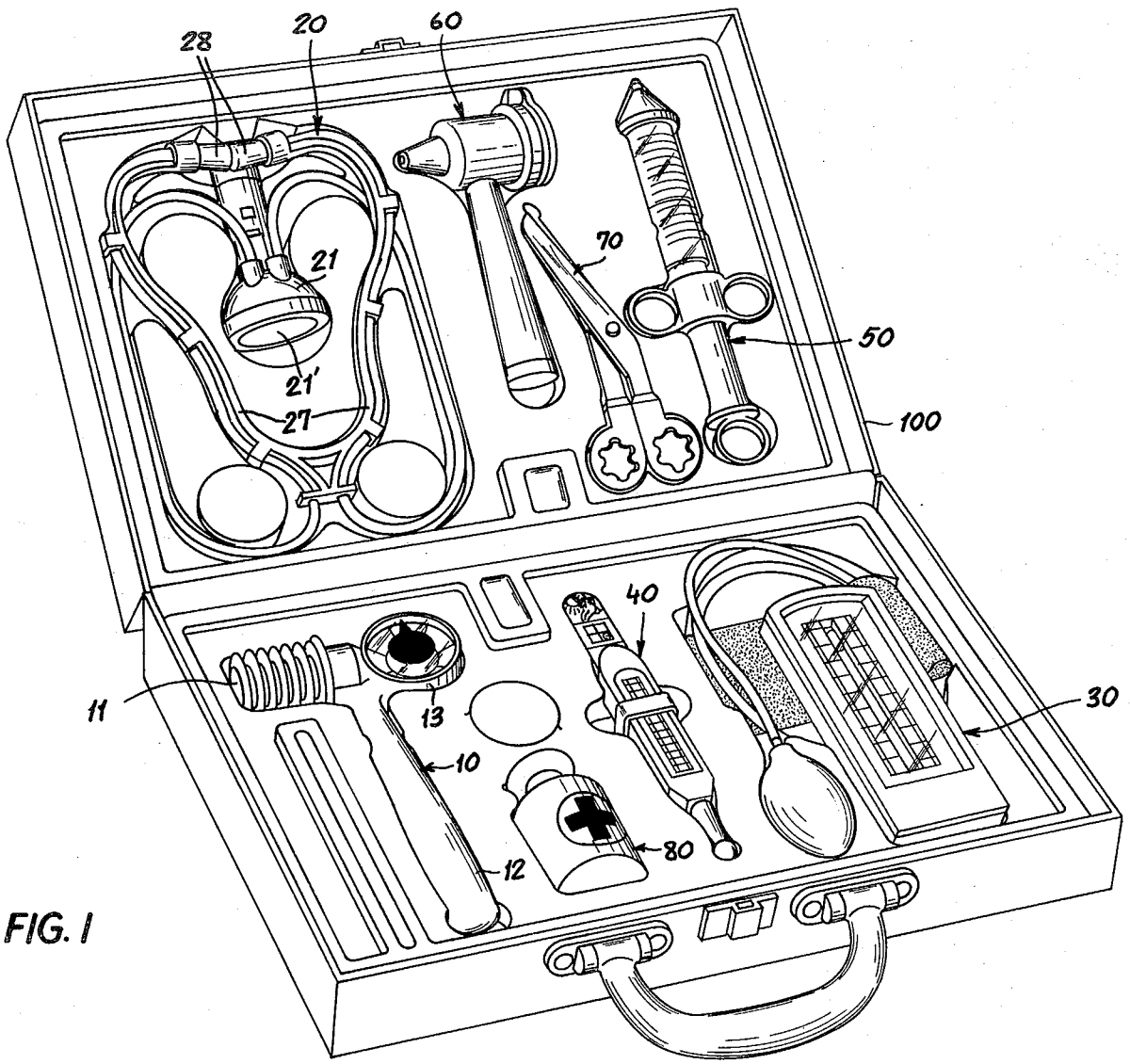
FIG. 1 is a perspective view of a pseudo-medical kit or make-believe doctor's bag containing a number of toys simulating actual physician's instruments.

In FIG. 1 I have illustrated a toy medical kit with a case 100 containing a variety of make-believe instruments including a reflex hammer 10, a stethoscope 20, a sphygmomanometer 30, a thermometer 40, a syringe 50, an ophthalmoscope 60, shears 70 and a jar 80. At least some of these devices may be designed, in a manner more fully described hereinafter, as active implements according to my invention.

Figure 2:
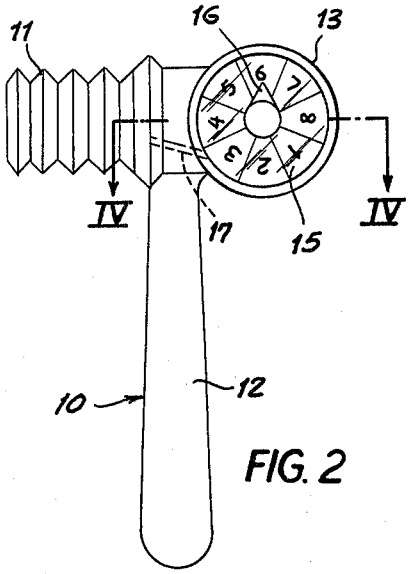
FIG. 2 is a side-elevational view of a reflex hammer forming one of the toys included in the kit of FIG. 1.
Figure 3:
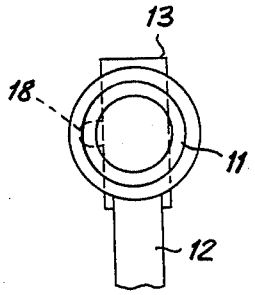
FIG. 3 is a face view of the hammerhead of the toy shown in FIG. 2.
Figure 4:
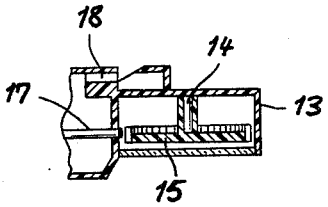
FIG. 4 is a fragmentary cross-sectional view taken on the line IV—IV of FIG. 2.

The reflex hammer 10 has been shown in FIGS. 2 and 3 as comprising a hammerhead 11 of synthetic resin, in the form of a cylindrical bellows, mounted on a handle 12. On the opposite side of this handle, the hammerhead 11 is extended into a flattened housing 13 of circular outline axially traversed by a shaft 14 (FIG. 4) which supports a dial-carrying disk 15. A stationary pointer 16, which may be painted on the transparent front wall of the housing, coacts with that dial. An air channel 17 formed by a small tube extends between the interior of bellows 11 and an entrance port of housing 13 confronting the periphery of disk 15 which is designed as an impeller wheel with blades in the path of the air flow exiting from channel 17 when the bellows 11 is compressed by a blow of the hammerhead against an object. The resulting rotation of disk 15 then causes a displacement of its dial relative to the pointer 16.

Figure 5:
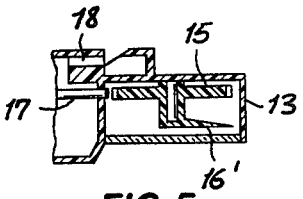
FIG. 5 is a view similar to FIG. 4, illustrating a modification.

As illustrated in FIG. 5, I may modify the signaling means in housing 13 by mounting a pointer 16' on the shaft of the impeller wheel 15 for rotation thereby; the dial may then be painted on the transparent housing wall.

As further shown in FIGS. 2–5, the hammerhead 11 is provided with a restricted opening 18 through which air from the compressed bellows can escape with a whistling sound. Thus, a blow of this reflex hammer has the dual effect of giving a visual as well as an audible signal.

Figure 6:
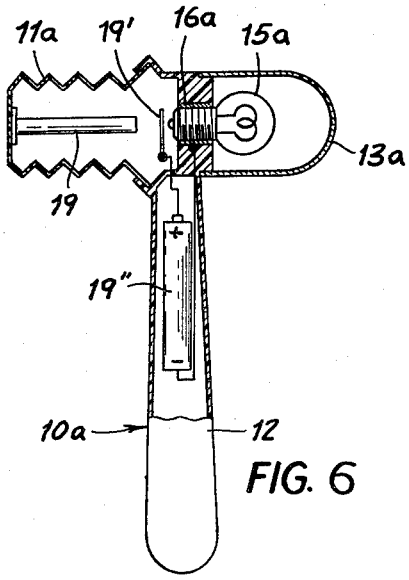
FIG. 6 is a sectional elevational view of another embodiment of a toy reflex hammer, generally similar to that of FIG. 2.

A similar reflex hammer **10*a*, shown in FIG. 6, is provided in the interior of its bellows 11*a* with an axial pin 19 which, upon compression of the bellows by a blow, bears upon a contact spring 19' to close an energizing circuit for a signal lamp 15*a* in a transparent or translucent housing 13*a* forming a rearward extension of hammerhead 11***a*. Spring 19' is connected to one terminal of a battery 19'' in handle 12*a*, the other terminal of that battery being connected to a socket 16*a* for the lamp 15*a*.

Figure 7:
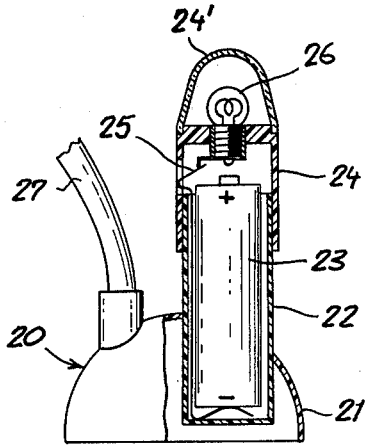
FIG. 7 is an elevational view, partly in section, of a portion of a toy stethoscope according to my invention included in the kit of FIG. 1.

The toy stethoscope 20 is shown in FIG. 7 to comprise a cup-shaped housing 21, resembling a chest piece, which is spanned on its underside by a membrane 21' (see FIG. 1) and has a tubular boss 22 forming a receptacle for a battery 23. A sleeve 24, designed as a handgrip, slidably surrounds the boss 22 and is anchored thereto by a contact spring 25 in the form of a conductive element whose lower end engages one terminal of the battery and whose upper end is shaped into a clip projecting into a cutout of sleeve 24 for releasably holding same in position with limited relative axial mobility. Sleeve 24 is topped by a translucent cap 24' containing a signal lamp 26 whose base is threaded into a socket which is in electrical contact with spring 25, that spring also urging the sleeve upward to separate a contact point at the bottom of lamp 26 from the upper terminal of battery 23. Thus, when a user gripping the sleeve 24 presses the cup 21 against an object, e.g. the chest of a doll or another child, the gap between lamp 26 and battery 23 is closed to illuminate the translucent cap 24'.

Stethoscope 20 also comprises flexible links 17, preferably in the form of plastic tubing, extending to a pair of earplugs 28 illustrated in FIG. 1. Noise generated by relative movements of cap 21 and sleeve 24 may be audibly perceived through the earplugs.

Figure 9:
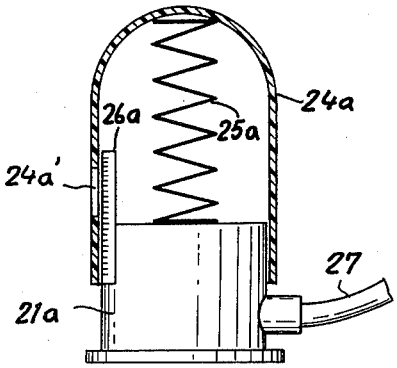
FIG. 9 is a cross-sectional view taken on the line IX—IX of FIG. 8.
Figure 8:
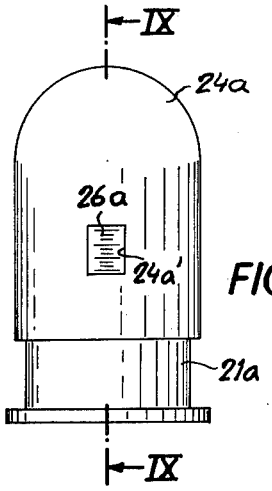
FIG. 8 is an elevational view of part of a modified toy stethoscope.

In FIGS. 8 and 9 I have shown part of a modified toy stethoscope wherein the handgrip 24*a* is an opaque, generally bell-shaped casing in which a cylindrical cup 21*a* is axially slidable while being biased outward by a compression spring 25*a* inside the casing. Cup 21*a* is rigid with a scale carrier 26*a* whose markings are partly visible through a window 24*a'* in that casing. Thus, the scale carrier 26*a* visually indicates the relative position of the chest piece 21*a* and the handgrip 24*a* which may be movably anchored thereto by a clip similar to the spring of FIG. 7.

Figure 11:
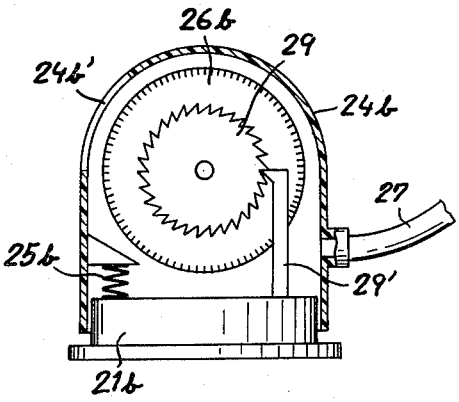
FIG. 11 is a cross-sectional view taken on the line XI—XI of FIG. 10.
Figure 10:
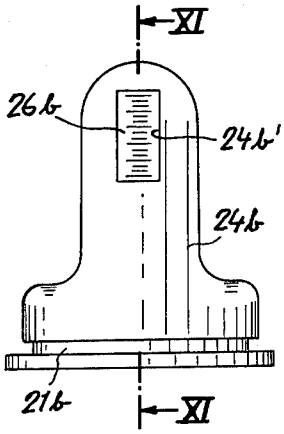
FIG. 10 is a view similar to FIG. 9, illustrating another modification of a toy stethoscope.

FIGS. 10 and 11 show another modified handgrip 24*b* with a flattened upper part in which a scale-carrying indicator disk 26*b* is rotatably journaled so as to be partly visible through a slot 24*b'*. Disk 26*b* is rigid with a ratchet 29 coacting with a resilient pawl 29' which rises from the cup-shaped chest piece 21*b*. A compression spring 25*b* bears upon the cup 21*b* and on an internal ledge of casing 24*b*, urging them apart against the retaining force of a nonillustrated spring clip or the like. Thus, an inward motion of cup 21*b* relative to casing 24*b* will step the ratchet 29 and thereby change the reading of the scale visible through slot 24*b'*.

Figure 12:
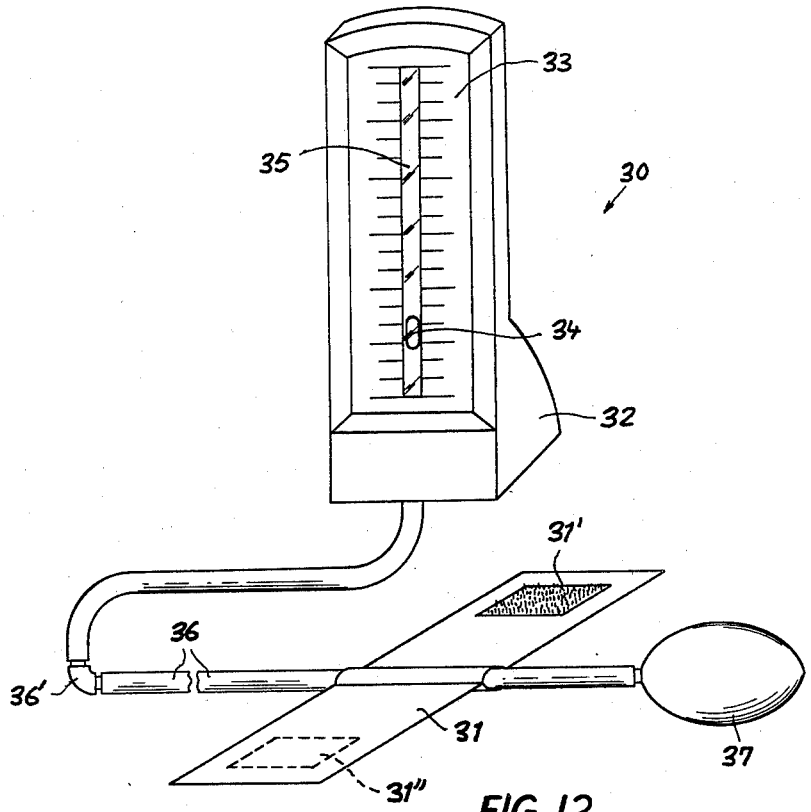
FIG. 12 is a perspective view of a toy sphygmomanometer included in the kit of FIG. 1.

FIG. 12 shows the toy sphygmomanometer 30 as comprising a strap 31 which simulates an inflatable cuff adapted to be wound about the upper arm of a patient. Thus, the extremities of the strap 31 are provided with patches 31' and 31'' of Velcro fastener enabling the strap to be closed upon itself. The body of the device further includes an upright housing 32 in which a scale carrier 33 coacts with a traveler 34 inside a transparent tube 35. This tube communicates via a flexible conduit 36, here shown provided with an elbow 36', with a hollow ball 37 of resilient resinous material whose compression by the user drives the traveler 34 upward inside tube 35 to give a visual indication of a simulated pumping action. The traveler may be a short pin or a small ball of light metal whose diameter is somewhat less than the inner tube diameter. Tube 35 is embedded in the scale carrier 33 with sufficient clearance to maintain communication between its interior and the surrounding atmosphere.

Figure 13:
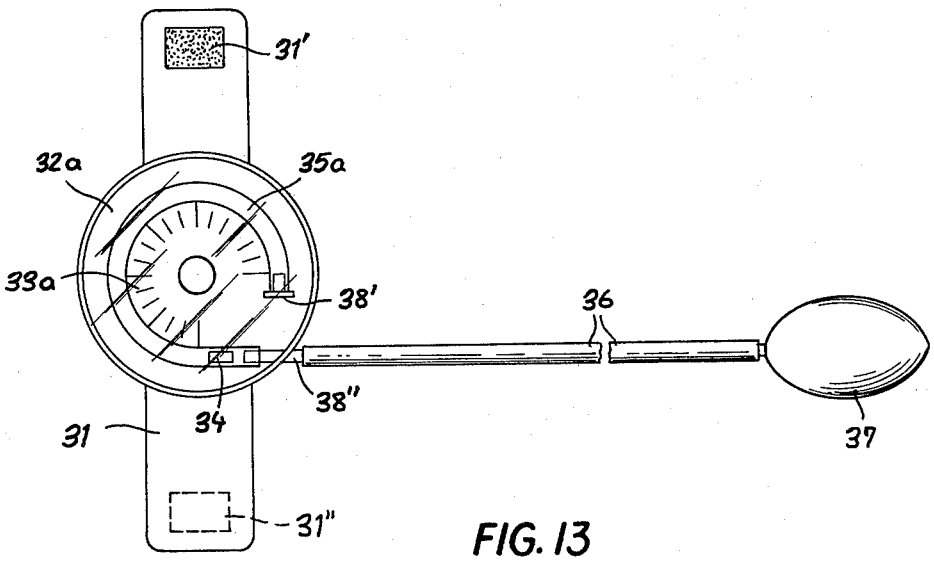
FIG. 13 is a plan view of a modified toy sphygmomanometer.

The toy sphygmomanometer of FIG. 13 is similar to that of FIG. 12, except that the upright housing 32 has been replaced by a flat disk 32*a* mounted directly on the strap 31. Disk 32*a* carries a scale 33*a* surrounded by an arcuate transparent tube 35*a* which is partly closed, at its free end remote from conduit 36, by a perforated plug 38'. A ferrule 38'' connects tube 35*a* with conduit 36 and, like plug 38', forms an end stop for the traveler 34.

Figure 14:
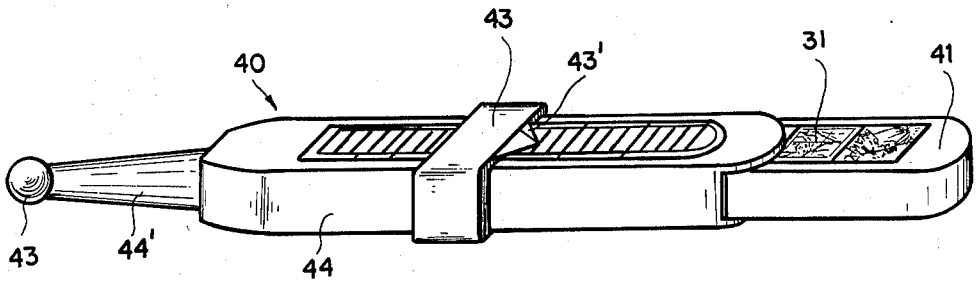
FIG. 14 is a perspective view of a toy thermometer included in the kit of FIG. 1.
Figure 15:
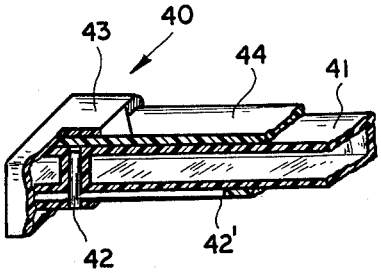
FIG. 15 is a fragmentary perspective view, partly in section, of the toy thermometer shown in FIG. 14.
Figure 16:
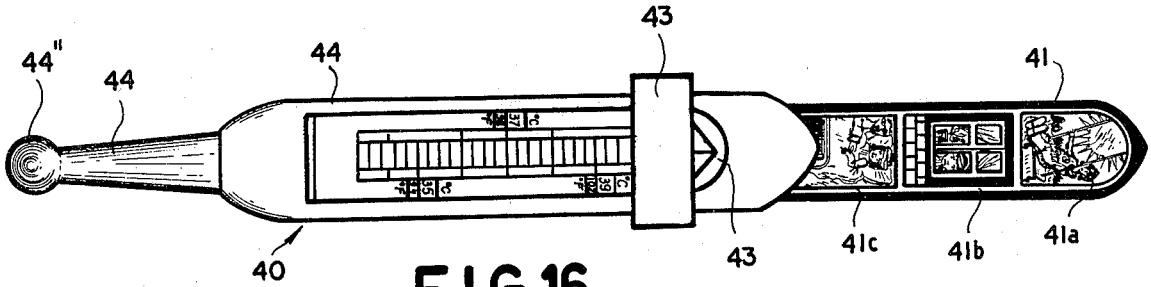
FIG. 16 is a face view of the device of FIGS. 14 and 15 in an extended position.

In FIGS. 14, 15 and 16 I have shown details of the toy thermometer 40. The body of that thermometer comprises a bar 41 which is connected by a pin 42 with a handgrip 43 in the form of a rectangular band slidably embracing a scale carrier designed as an elongate casing 44 into which the bar 41 may be fully retracted. Casing 44 has a stem 44' terminating in a sphere 44'' to simulate the bulb of a clinical thermometer.

Band 43 carries a pointer 43' coacting with a scale on casing 44 which may be marked with °C. or °F. in the normal range of body temperatures. The user holding the handgrip 43, with the device in an upright position so that casing 44 descends by gravity to reveal three pictures 41*a*, 41*b* and 41*c* on bar 41, may now rest the tip 44'' on an object such as the lips of a recumbent doll whereby the bar may be partly or fully retracted into the casing. With pointer 43' lowered to about the middle of the scale, only the top picture 41*a* is visible and shows a child playing outdoors to indicate normal health. Raising the pointer into the upper half of the scale reveals the next picture 41*b* which shows a child peering out a window to suggest an elevated temperature calling for a stay indoors. When the pointer is moved to the top of the scale, picture 41*c* appears and shows a bedridden patient, suggesting high fever.

The relative displacement of band 43 and casing 44 is limited by the length of a slot 42' on the rear wall of that casing which is traversed by the pin 42. A spring, not shown, may bias the bar 41 and the casing 44 into their relatively extended position.

Figure 17:
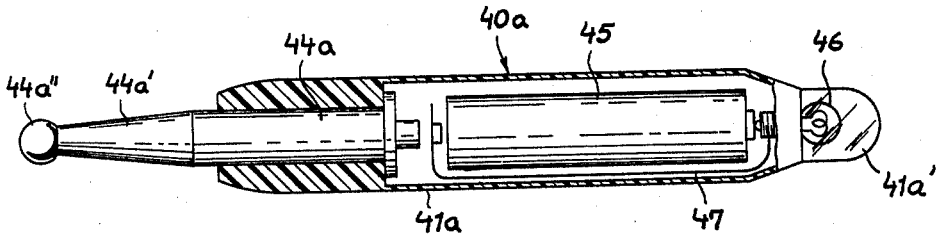
FIG. 17 is a sectional view of another toy thermometer.

In FIG. 17 I have shown a modified toy thermometer 40*a* which is generally similar to the parts of the toy stethoscope 20 seen in FIG. 7. A casing 41*a* accommodates a battery 45 and a lamp 46 along with a contact spring 47 having one end secured to the lamp socket and an opposite end normally spaced from the confronting battery terminal. A slider 44*a* in casing 41*a*, terminating in a stem 44*a'* with a bulb 44*a''*, thrusts the free end of spring 47 into contact with the adjoining battery terminal when the bulb 44*a''* is rested on an external object, thereby lighting the lamp 46 which is surrounded by a translucent end cap 41*a'* of casing 41*a*.

Figure 18:
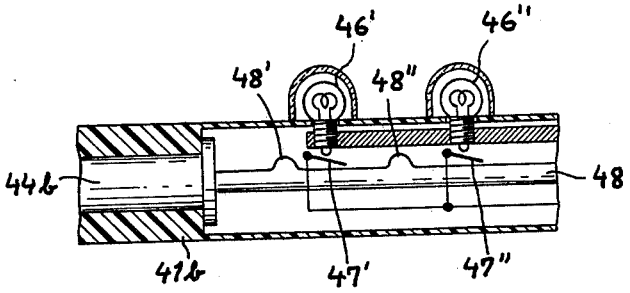
FIG. 18 is a fragmentary sectional view of a modification of the device of FIG. 17.

As illustrated in FIG. 18, a slider 44*b* in a casing 41*b* is integral with a rod 48 carrying cams 48', 48'' closing contacts 47', 47'' for respectively energizing a plurality of lamps 46', 46'' (only two shown) from a nonillustrated battery in dependence upon the extent to which the slider 44*b* is thrust into the casing 41*b*. A number of such lamps, therefore, may be lit up in different positions of a pointer, carried by the slider, coacting with a temperature scale on the casing.

Figure 19:
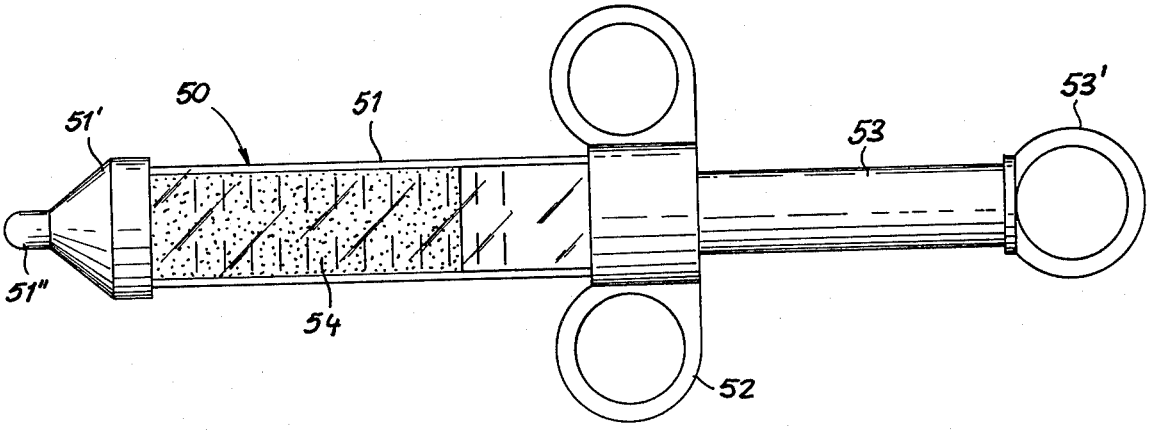
FIG. 19 is a face view of a toy syringe included in the kit of FIG. 1.

Finally, I have shown in FIG. 19 details of the syringe 50 which comprises a transparent cylindrical body 51 rigid with a handgrip 52, cylinder 51 being closed by an opaque cap 51' terminating in a rounded top 51''. A plunger 53 with a gripper ring 53' extends into the cylinder 52 and bears upon an elastic pad 54 in that cylinder, e.g. of sponge rubber, which is colored red to simulate a volume of blood. When the user thrusts the plunger 53 deeper into the cylinder, pad 54 is compressed to give the appearance of an expulsion of blood from the device. Conversely, a retraction of the plunger lets the pad expand to simulate the intake of blood into the cylinder. The pad 54, therefore, acts as a nonfunctional visual indicator, as do the various signal generators of FIGS. 2–18.

It will be understood that other make-believe instruments in the kit of FIG. 1, e.g. the ophthalmoscope 60, could also be equipped with signal lamps or other indicators responsive to a displacement or a deformation of a nonfunctional member in conformity with my present invention.

I claim:

1. A toy for a pseudo-medical kit, designed to simulate a stethoscope, comprising:

a cup resembling a stethoscope chest piece, said cup having a rim adapted to rest on an external object and further having an outwardly projecting tubular boss remote from said rim;

a pair of earplugs connected to said cup via flexible links;

a manually grippable sleeve slidably engaging said boss with freedom of limited relative displacement between an extended normal position and a compressed position, said sleeve being provided with a light-transmissive portion;

spring means anchored to said boss and said sleeve for tending to maintain same in their normal relative position; and a signal lamp seated in said sleeve and provided with an energizing circuit closable for transluminating said light-transmissive portion upon displacement of said sleeve relative to said boss into said compressed position.

2. A toy as defined in claim 1 wherein said spring means comprises a conductive element included in said energizing circuit.

3. A toy as defined in claim 2 wherein said energizing circuit includes a battery with a pair of opposite terminals, said signal lamp being provided with a contact point confronting one of said terminals and with a base threaded into a socket, said conductive element having one end engaging said socket and another end engaging the other of said terminals, said one end tending to keep said contact point away from said one of said terminals.

4. A toy as defined in claim 2 or 3 wherein said conductive element forms a clip projecting into a cutout of said sleeve.

* * * * *